United States Patent [19]

Kirby et al.

[11] 3,978,806

[45] *Sept. 7, 1976

[54] VESSEL WITH FLOODED HOLD FOR TRANSPORT OF BARGES

[75] Inventors: William Everett Kirby, Victoria, Hong Kong; David Jackson Seymour, Daly City, Calif.

[73] Assignee: Wharton Shipping Corporation, Panama

[ * ] Notice: The portion of the term of this patent subsequent to Oct. 21, 1992, has been disclaimed.

[22] Filed: June 3, 1975

[21] Appl. No.: 583,439

[52] U.S. Cl. ..... 114/43.5 VC

[51] Int. Cl.[2] ..... B63B 35/44

[58] Field of Search ..... 114/43.5 VC, 43.5 R, 114/72

[56] References Cited

UNITED STATES PATENTS

| | | | |
|---|---|---|---|
| 3,448,711 | 6/1969 | Mulholland | 114/72 |
| 3,499,410 | 3/1970 | Field et al. | 114/125 |
| 3,583,350 | 6/1971 | Goldman | 114/72 |

FOREIGN PATENTS OR APPLICATIONS

| | | | |
|---|---|---|---|
| 1,400,750 | 4/1965 | France | 114/43.5 VC |

*Primary Examiner*—Trygve M. Blix
*Assistant Examiner*—Gregory W. O'Connor
*Attorney, Agent, or Firm*—Owen, Wickersham& Erickson

[57] ABSTRACT

A vessel for transport of floating buoyant barges and other containers wherein said barges or containers are partially supported in the vessel by their own buoyancy. The vessel's hull has a bottom shell with rigid submarine barge-supporting and hull-reinforcing structure, a bow, a stern, side walls providing a series of buoyancy compartments, and a hollow enclosed interior including a cargo hold. The hull has conduit means communicating with the ocean for free passage of water into and out from the hold at all times, so that the hold is always flooded to the same level as the vessel's draft during the voyage. A series of locking spuds releasably locks the barges in place in the flooded hold against movement relative to the hull, with the bottom of the barge engaging a substantial area of the submarine cargo-supporting structure. Each said spud has barge-engaging means, including an L-sectioned beam of substantial length for engaging an upper side edge of the barge over a substantial length. There may also be similar spuds for holding other types of containers in place, in cooperation with suitable support structures. The vessel may have a bulkhead along its longitudinal centerline and stow barges and containers on both sides of the bulkhead in two longitudinal holds. The holds may be covered by a continuous deck to protect barges and cargo loaded on the decks of the barges.

7 Claims, 10 Drawing Figures

VESSEL WITH FLOODED HOLD FOR TRANSPORT OF BARGES

BACKGROUND OF THE INVENTION

This invention will relate to a vessel for transport of floating buoyant barges and other containers.

Our earlier filed U.S. patent application, Ser. No. 511,492, filed Oct. 2, 1974, now U.S. Pat. No. 3,913,512 Dated Oct. 21, 1975, describes a vessel in which barges or other types of containers are partially supported in the vessel by their own buoyancy and wherein they are loaded in and out while floating in the sea. The present invention may be considered an improvement or a modification of that invention.

Like that invention, the present invention utilizes a hold which is at all times kept flooded and in free communication with the ocean. The present invention is more particularly directed to the use of barges such as those used in the Lykes' SEABEE barge container cargo program, and is adapted to accommodate these barges. In some forms of the invention it will accommodate the SEEBEE type of barge as substantially the only type of container, while in others it will accommodate other types of barges or containers, and some forms of the invention provide for mixed cargoes in which some of the containers are one kind of barge and others are a different kind of barge or containers.

The broad claims in the previous application cover the general aspects of the present invention, but that application does not show specific apparatus for retaining in place some of the very large barges that can be used with the present vessel. In the prior invention the illustrations and the descriptions related to the use of LASH type of containerized cargo lighters or units, and these units were relatively small and with specially reinforced supports and lifting points so that they could be secured by projections in the submarine cargo-supporting structure of the vessel which engaged sockets provided in the bottom corners, as standard practice, in those LASH lighters; and the LASH lighters were held in place in the vessel by hydraulically actuated spuds having sockets which engaged projections extending up from each of the four corners of the LASH container. The present invention accommodates the much larger barges where the four-point LASH support system is inadequate. In the present invention the spuds which hold the barges in place are adapted to engage portions of substantial length along the upper side edges of the barges to provide needed adequate retention.

In our prior application, Ser. No. 511,492, now U.S. Pat. No. 3,913,512 we also illustrated a system in which the LASH lighters were placed in the hold athwartships sideways rather than fore and aft. This was quite practical with those relatively small containers, but it is impractical when the barges are long, because it would require an excessive beam width for the transporting vessel. Accordingly, the present invention solves the problem of excessive beam width by providing a novel structure in which the hold is divided into two longitudinally extending parts by a centerline bulkhead or partition, and the barges or other containers are loaded into the two hold sections in a fore-and-aft orientation. This hold structure enables a large number of such barges to be carried and accommodated rather than having to have excessive beam width and enables fore-and-aft loading and unloading.

Another form of the invention illustrates a "Coaster" type of vessel in which a still different type of barge is used, namely, a deck barge which requires that the transporting vessel be covered to protect exposed deck cargo on the barges. The vessel accommodates the Coaster barges in a similar manner, using the divided hold, fore-and-aft loading, and spuds like those for the SEABEE type of barges, possibly located at different intervals in order to accommodate them.

Yet another form of the invention enables mixed loading of SEABEE barges and LASH containers or other types of barges or containers. By providing a structure in which both kinds of spuds are used, some being used to provide a fourcorner locking of LASH containers and others being used to provide a locking contact for the large barges distributed over long edge contact areas.

SUMMARY OF THE INVENTION

The present vessel is like that of application Ser. No. 511,492, now U.S. Pat. No. 3,913,512, in that it has a flooded hold common with the sea. Its hull has a bottom shell and rigid submarine barge-supporting hull-reinforcing structure; there are the usual bow, stern, and side walls, and the buoyancy compartments are provided by the side walls. The interior of the hold is kept in communication with the ocean for free passage of water into and out from the hold at all times during the voyage, and the buoyancy compartments, of course, are provided with the usual means for pneumatic or hydraulic pumping for ballasting and deballasting with sea water, to adjust the draft, trim, and list of the vessel. Gate means may be provided at either end or at both ends of the hull for enabling floatation loading and unloading of the barges. The bottom of the barge engages a substantial area of the submarine cargo-supporting structure while a series of locking spuds is provided for releasably locking the barges in place in the flooded hold. The spuds each have an L-section beam of substantial length for engaging an upper side edge of the barge over a substantial length, to provide a locking action and a distribution of forces thereover.

As mentioned above, the hold is preferably divided into two side-by-side longitidinally-adjacent portions by a centerline partition or bulkhead so that the barges may be loaded fore and aft. The invention disperses the spuds at desired distances according to the sizes of the barges being used, and one embodiment of the invention provides for both the spuds just described and for spuds like those shown and described in the copending application Ser. No. 511,492.

Other objects and advantages of this invention will appear from the following description of several preferred embodiments.

DESCRIPTION OF SOME PREFERRED EMBODIMENTS

The vessel of FIGS. 1–4

Figure 1:
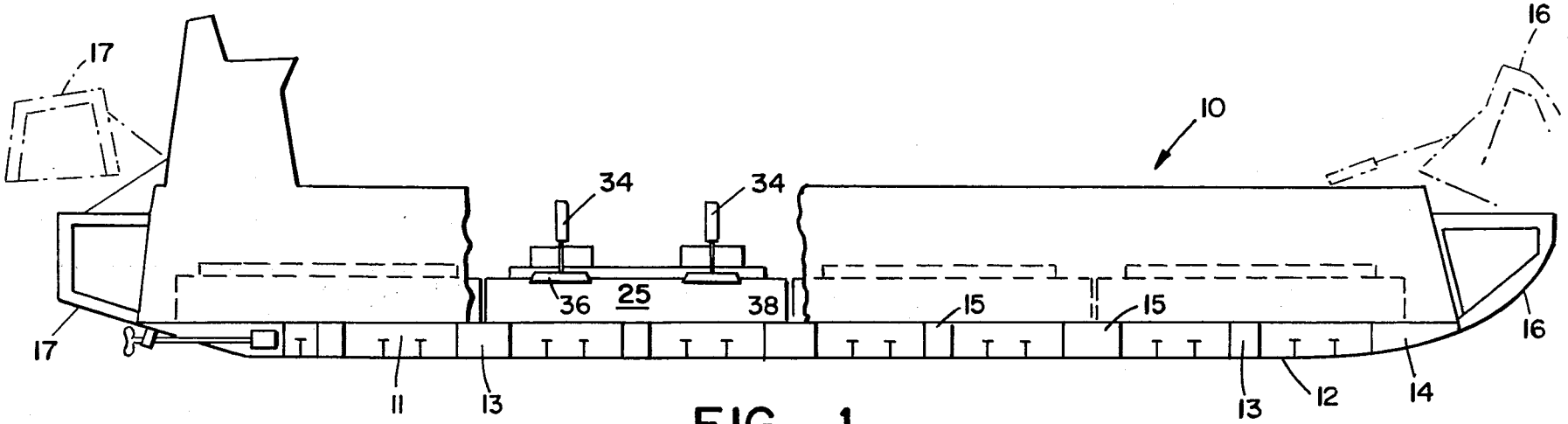
FIG. 1 is a somewhat diagrammatic view in side elevation of a vessel embodying the principles of the present invention. Some portions of the hull are broken away to show the interior, and gates are shown at each end with broken lines indicating their raised position for loading or unloading the vessel.

FIGS. 1–4 show a vessel 10 which is suitable for transporting large containerized barges of such type as the Lykes' SEABEE. The vessel 10 is provided with a hull 11 having a bottom 12 and a series of spaced apart transverse submarine-supporting structures 13. A transverse threshold structure 14 is provided at the bow. The transverse supporting structures 13 and the threshold structure 14 provide spaced apart supporting platforms 15 to support most of the bottom surface of the barges in position within the hull 11. The vessel 10 is shown as having a bow gate 16, shown in its closed position in solid lines and in its raised position for loading (or unloading) in broken lines. The vessel 10 may also have a stern gate 17 (which is likewise shown in broken lines in its loading and unloading position). If desired, only one of these gates 16, 17 may be present, and when that is done it is usually preferably the bow gate 16, but it could be the stern gate 17.

The vessel's hull 11 has outer side walls 20 which provide in combination, with inner side walls 21 a series of buoyancy chambers 22. These chambers 22 are provided with the usual means for admitting air under pressure (or hydraulic pumps) to regulate the ballast of sea water therein, and they provide means for ready adjustment of the vessel's draft, trim, and list. This feature is particularly important in a vessel of this kind where it may be desirable to unload and load the vessel 10 at a lower draft than the normal cargo-carrying displacement.

The vessel 10, as shown in FIGS. 1–4, accommodates two adjacent rows of long, rectangular and generally flat bottomed barges 25 of a type such as the Lykes' SEABEE barge. These barges are long, running over 90 feet in length with a beam of about 35 feet. They have decks 26 upon which cargo 27 is supported, or the cargo may be supported inside the barge 25, or it may be supported partly within and partly above the barge 25 on its deck 26.

In accordance with the present invention, the vessel 10 is provided with a central longitudinal bulkhead 31 extending generally from the stern to the bow so that the vessel 10 is, in effect, provided with two holds 32 and 33, each hold being sized to accommodate a series of loaded barges 25 in tandem. Since the barges 25 may be of substantial length, the submarine supporting structure 13 and the threshold structure 14 are spaced and sized to provide ample platform area 15 to support these barges and distribute the loading thereof.

Figure 2:
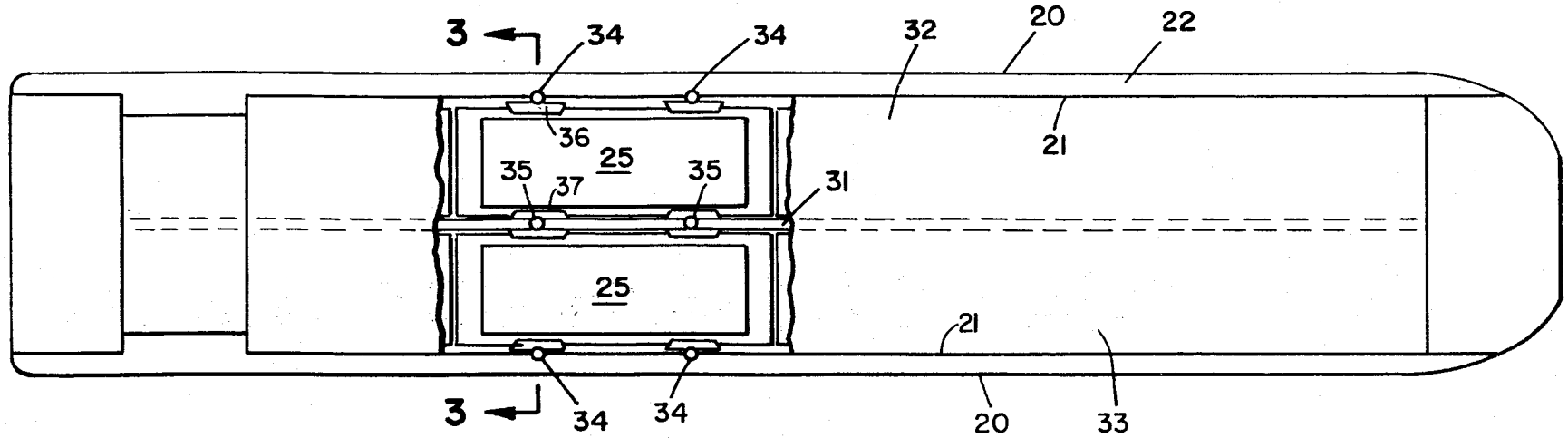
FIG. 2 is a top plan view of the vessel of FIG. 1 with some of the deck broken away to show two of the barges in place in the hold.
Figure 3:
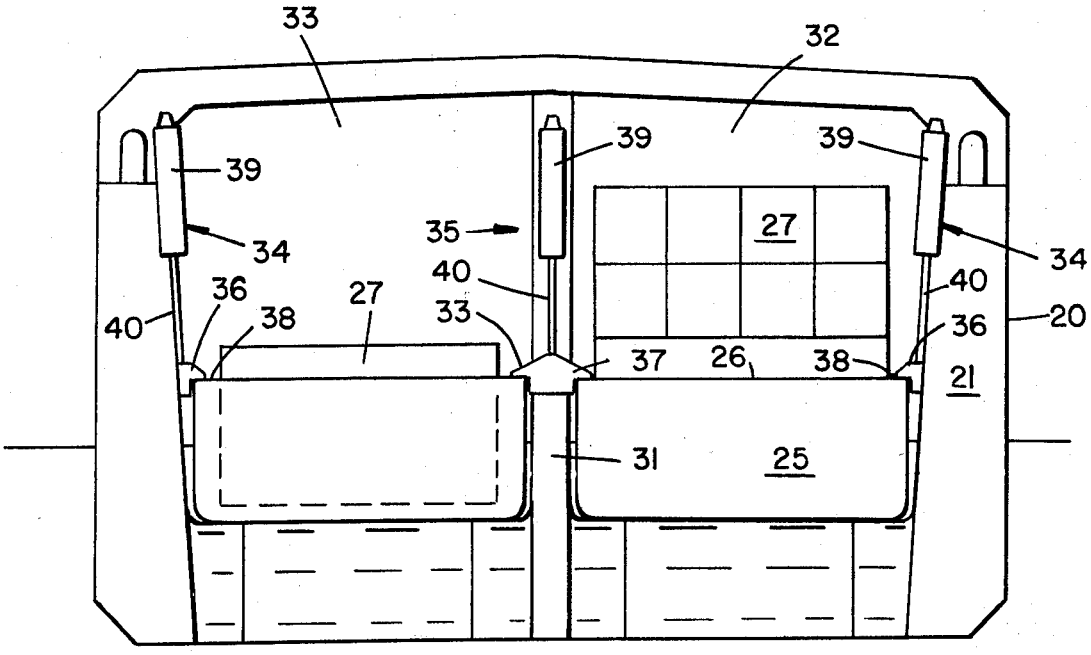
FIG. 3 is an enlarged view in section taken along line 3—3 of FIG. 2, showing barges in place in the hull with water therein.
Figure 4:
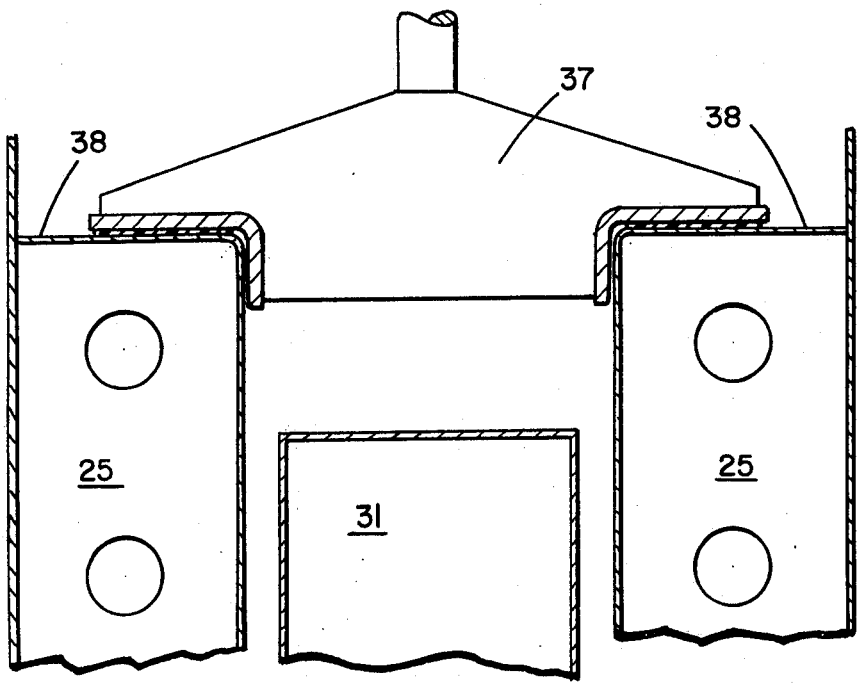
FIG. 4 is a further enlarged view of a portion of FIG. 3 showing engagement of the central holding means and opposite edges of two barges.

In combination with the submarine supporting structure 13 and threshold structure 14, the vessel 10 is provided with a series of spaced apart barge-clamping spuds generally of two types: side wall spuds 34 and central bulkhead spuds 35. The spuds 34 and 35 function to hold the barges 25 in place against the platforms 14 and 15 of the submarine supporting structure 13. As best shown in FIGS. 1 and 2, the spuds 34 and 35 are provided with longitudinal clamping members 36 and 37, respectively. The L-sectioned clamps 36 and 37 are sized to engage a substantial upper edge portion 38 of each barge side wall to provide a firm locking action and to distribute more evenly the pressures and forces which may be induced in the vessel 10 during its operations. The spuds 34 and 35 may be provided in any desired number, but four or six per barge is usually sufficient. The side wall spuds 34 are secured to each side of the hull 11 so that each engages only one barge 25 while the central spuds 35 which are secured in the central bulkhead 31 may each lock barges 25 on both sides thereof. Each spud typically consists of a controlled hydraulic device in which the cylinder or the piston is stationary while the other one is movable. In FIG. 3 the cylinders 39 are shown as stationary, and the pistons 40 are shown as extensible and retractable in accordance with actuation of the hydraulic mechanism. The longitudinal clamps 36 and 37 are mounted at the ends of the pistons 40. Each clamp 36 and 37 may be an L-shaped beam which engages a substantial area of the top and side faces along a portion of the edge 38 of the barge 25. The centerline bulkhead spuds 35 may carry a double clamp 37 while the side wall spuds 34 carry a single clamp 36. It will be noted that the spuds are preferably not located at the corners of the barges 25 but are spaced inwardly therefrom at a distance of about one-fourth the length of the barges 25.

Figure 5:
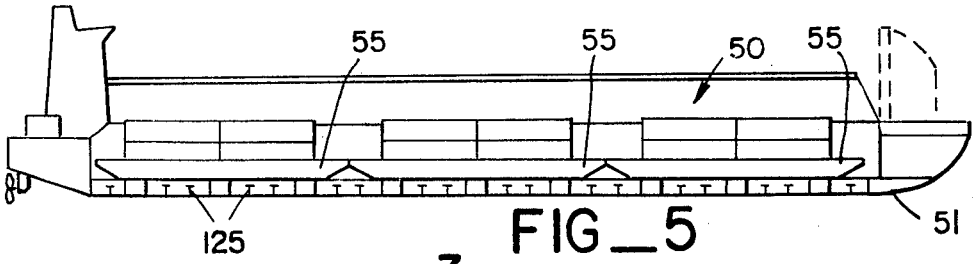
FIG. 5 is a somewhat diagrammatic view in side elevation and in section of a modified form of vessel embodying the principles of the invention.
Figure 6:
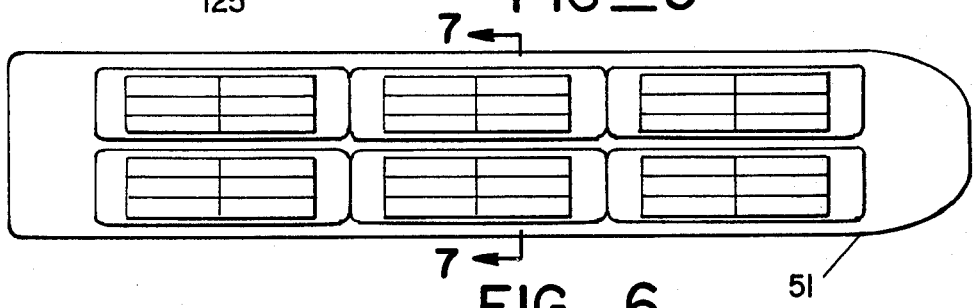
FIG. 6 is a top plan view of the vessel of FIG. 5 with the deck broken away to show two rows of barges in the parallel longitudinal holds thereof.
Figure 7:
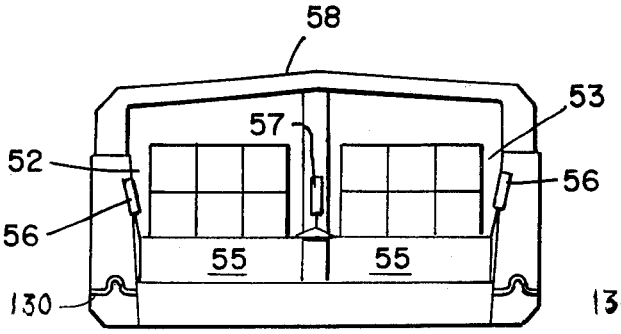
FIG. 7 is an enlarged view in section taken along line 7—7 of FIG. 6 and showing the covered deck necessitated by the barges shown.

Vessel of FIGS. 5–7 (Coaster)

A vessel 50, shown in FIGS. 5, 6 and 7, is generally similar to the vessel 10 shown in FIGS. 1–4 but may be somewhat smaller. its hull 51 may be divided by a centerline longitudinal bulkhead 54 into two side-by-side holds 52 and 53, each suitable for accommodating three barges 55 in tandem. The barges 55 shown have no holds and support their cargo entirely on their decks, as best shown in FIG. 7. Spuds 56 and 57, similar to those previously discussed, are used to secure these flat barges 55 within each hold, and since the cargoes are lashed or locked to the barges 55, the cargoes, too, are held in place. The location of the spuds 56 and 57 and their dimensions are arranged to accommodate these particular barges.

Figure 8:
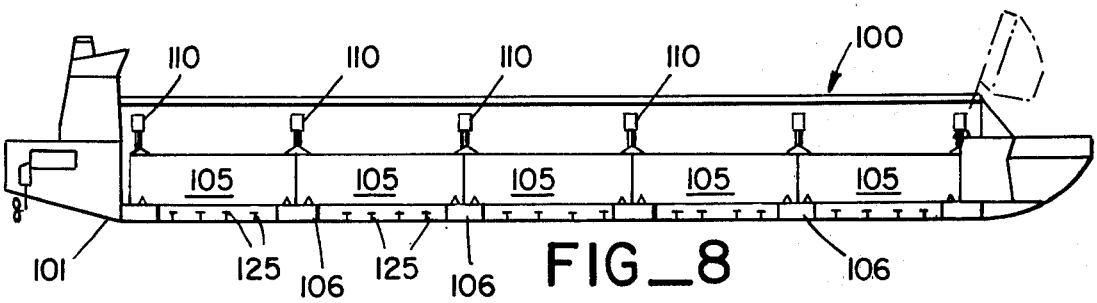
FIG. 8 is a diagramatic view in side elevation and in section of a further embodiment of the vessel of the present invention. A bow gate is shown with broken lines indicating its raised position for loading and unloading the vessel.
Figure 9:
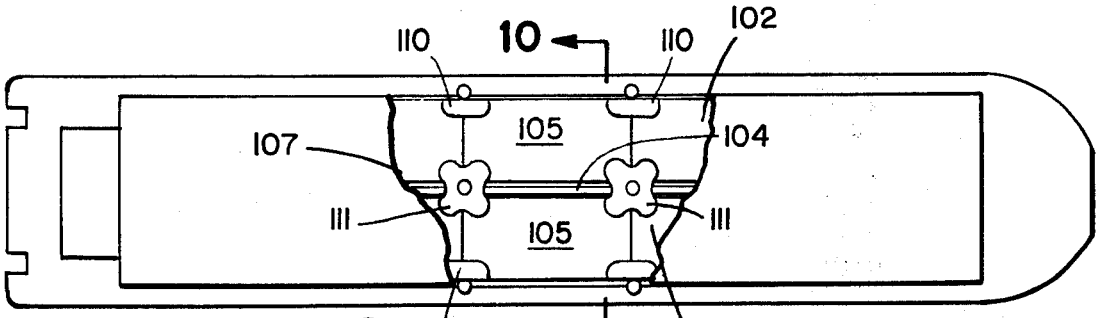
FIG. 9 is a top plan view of the vessel of FIG. 8 with a portion of the deck broken away to show LASH lighters in the port and starboard holds.
Figure 10:
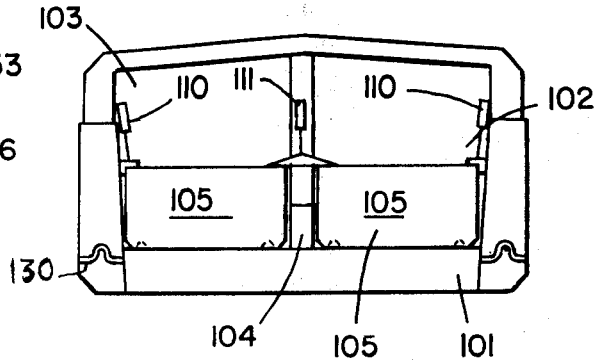
FIG. 10 is an enlarged view in section taken along line 10—10 of FIG. 9.

Vessel of FIGS. 8–10

The vessel of FIGS. 8–10 is very similar to the vessels previously described herein. This vessel 100 has a hull 101 divided into two adjacent holds 102 and 103 by a longitudinal bulkhead 104. LASH type lighters 105 are loaded in an end-to-end tandem into each hold and are positioned over submarine supporting structure 106.

As shown in FIG. 10, two types of locking spuds are utilized in the holds 102 and 103. Outer spuds 110 are secured to the hull 101 whereas central spuds 111 are mounted to the longitudinal bulkhead 104. The outer spuds 110 are each able to lock down two adjacent corners of two lighters whereas the central spuds 111 are able to lock down four corners of four adjacent lighters. The spuds 110 and 111 (and the submarine suppporting structure 106 of the hull 101) are designed for the LASH type containers 105 and may be provided with suitable socket-engaging (and projection) members for holding the LASH containers 105 in place.

In the vessel of FIGS. 8–10, the preferable mode of operation is to load the containers into one hold and then load them into the other hold and then to adjust for any differences in loading by the buoyancy chambers in the side walls of hull 101. Another suitable mode of operation would be to load the holds simultaneously with containers, if preferred.

It is to be understood that the vessels of the three embodiments of the present invention employ the same unique buoyancy transfer principle which will now be explained. During loading operation the vessel's buoyancy tanks in the side walls of the hull are ballasted with sea water which lowers the vessel in the water. The containers and barges then are floated into the holds of the vessel over its submarine structure in a train or tandem series by the action of a winching system which may be in the hull of the vessel. In a vessel having only one loading gate, it is used for passage both in and out. Tugboats may be used in addition to, or in lieu of, the winching system to push and pull the tandem trains of the barges and lighters in and out of the holds. Normally, due to various degrees of loading and various cargo densities, the containers and barges will not all float at the same level. Thus, the vessel will be ballasted to admit a barge having the greatest draft.

When all the lighters and barges have been brought inside the holds of the vessel, they are roughly positioned with respect thereto. The buoyancy tanks in the side walls of the hull may then be deballasted by pumps to lighten the vessel so as to cause the heaviest laden of the barges or lighters to rest on the cross girders of the hull structure. The containers are aligned during deballasting so that they will eventually rest at appropriate positions on transverse submarine structure of the hull which is positioned to distribute the weight of the barges and lighters to the vessel.

With the containers in position, the hydraulic spuds are then extended to lock the barges and containers securely within the holds. When the containers are all engaged and pushed down to their lowermost positions, they are secured for the voyage and they are held at the same level in the holds.

The vessel is then deballasted to a predetermined level so that it is supported partly by its own buoyancy and partly by the buoyancy of the barges and containers in its holds. Thus, there is an interchange of buoyancy between the vessel and the containers in it, and the waterline of the vessel can be adjusted by deballasting the ballasting to cause the buoyancy of the containers and barges to help buoy the vessel as well as help carry the load in the ocean.

It is further to be noted in connection with the vessels of the present invention that during the voyage, the holds are flooded because of the continuous communication with the ocean via, e.g., connecting tubes 130. Under some voyage conditions of severe pitching and motion of the vessel, the flood waters in the hold may create pressures on the barges and containers which can be minimized by the inclusion of a series of transverse perforate swash bulkheads 125. These bulkheads are suitably placed between the submarine superstructure of the vessel and serve to impede the flow of flood waters from, e.g., the bow to the stern as the vessel pitches during the voyage.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting. Note that the vessel is equally applicable to fresh and salt water uses.

We claim:

1. A vessel for transporting floating buoyant barges, wherein said barges are partially supported in the vessel by their own buoyancy, including in combination:

a hull having a bottom shell with rigid submarine barge-supporting and hull-reinforcing structure, a bow, a stern, and side walls providing a series of buoyancy compartments, and a hollow enclosed interior, a centerline longitudinal bulkhead dividing said interior into a pair of longitudinally extending cargo holds, said hull having conduit means communicating with both said holds for free passage of water therethrough into and out from said holds at all times, so that said holds are always flooded during the voyage, means for introducing and expelling water from said buoyancy compartments to adjust the draft, trim, and list of said vessel, gate means in said hull for opening to enable flotation loading and unloading of said barges in fore-and-aft orientation into both said holds and for closing during transportation thereof, and three series of locking spuds for releasably locking said barges in place in said flooded holds against movement relative to said hull all during a voyage of said vessel, with the bottom of each said barge engaging a substantial area of said submarine cargo-supporting structure, each of said spuds having barge-engaging means, one series of said spuds being affixed to said longitudinal bulkhead and one series of spuds being affixed to each said side wall of said vessel, whereby the water in the flooded holds enables the buoyancy of the barge to support the vessel, at least in part.

2. The vessels of claim 1 wherein each spud of said series affixed to said longitudinal bulkhead includes clamp means extending into both said holds for releasably engaging a said barge in each said hold.

3. The vessel of claim 1 wherein some spuds of said series affixed to said longitudinal bulkhead are positioned to engage barges in one of said holds and other spuds of said series affixed to said longitudinal bulkhead are positioned to engage barges in the other of said holds.

4. The vessel of claim 1 wherein at least some of said spuds each includes an L-sectioned beam of substantial longitudinal length and area for engaging a substantial upper sidewall edge portion of a said barge.

5. The vessel of claim 1 wherein some of said spuds each includes an L-sectioned beam of substantial longitudinal length and area for engaging a substantial upper sidewall edge portion of one of said barges, and others of said spuds each engages a locking position of another type of said barges to provide a pin and socket locking engagement therewith, whereby different types of barges may be locked in place in the flooded holds of said vessel.

6. The vessel of claim 1 additionally comprising plural perforate spaced apart fixed transverse bulkheads intermediate said barge-supporting and hull-reinforcing structure.

7. A vessel for transport of floating buoyant barges, wherein said barges are partially supported in the vessel by their own buoyancy, including in combination:

a hull having a bottom shell with rigid submarine barge-supporting and hull-reinforcing structure, a bow, a stern, and side walls providing a series of buoyancy compartments, and a hollow enclosed interior including at least one cargo hold, said hull having conduit means communicating between said hold and the ocean for free passage of water therethrough into and out from said hold at all times, so that said hold is always flooded during the voyage, means for introducing and expelling water from said buoyancy compartments to adjust the draft, trim, and list of said vessel, gate means in said hull for opening to enable flotation loading and unloading of said barges and for closing during transportation thereof, and a series of locking spuds for releasably locking said barges in place in said flooded hold against movement relative to said hull all during a voyage of said vessel, with the bottom of said barge engaging a substantial area of said submarine cargo-supporting structure, each of said spuds having barge-engaging means including an L-sectioned beam of substantial transverse length for engaging an upper side edge of said barge over a substantial length, whereby the water in the flooded hold enables the buoyancy of the barge to support the vessel, at least in part.

* * * * *